US005297612A

United States Patent [19]

Korpela et al.

[11] Patent Number: 5,297,612

[45] Date of Patent: Mar. 29, 1994

[54] METHOD FOR CONTROLLING THE CLAMPING FORCES EXERTED ON A CONTINOUS CASTING MOLD

[75] Inventors: Thomas J. Korpela, Forest Hill; Lester A. Foster, Jr., Baltimore, both of Md.

[73] Assignee: Vöest-Alpine International Corporation, Pittsburg, Pa.

[21] Appl. No.: 982,417

[22] Filed: Nov. 27, 1992

Related U.S. Application Data

[63] Continuation of Ser. No. 565,041, Aug. 9, 1990, abandoned.

[51] Int. Cl.[5] ..... B22D 11/16

[52] U.S. Cl. ..... 164/452; 164/154

[58] Field of Search ..... 164/4.1, 451, 452, 491, 164/436, 154

[56] References Cited

U.S. PATENT DOCUMENTS

| | | | |
|---|---|---|---|
| 2,824,346 | 2/1958 | Osborn | 164/452 |
| 4,300,620 | 11/1981 | Wolf | 164/452 |
| 4,304,290 | 12/1981 | Wolf | 164/491 |
| 4,487,249 | 12/1984 | Wrhen | 164/452 |
| 4,635,704 | 1/1987 | Chielens | 164/452 |
| 4,960,165 | 10/1990 | Eidinger | 164/491 |

FOREIGN PATENT DOCUMENTS

| | | | |
|---|---|---|---|
| 0107564B2 | 5/1990 | European Pat. Off. . | |
| 2501868 | 7/1976 | Fed. Rep. of Germany | 164/451 |
| 55-88958 | 7/1980 | Japan | 164/452 |
| 58-202961 | 11/1983 | Japan | 164/452 |
| 59-73161 | 4/1984 | Japan | 164/452 |
| 62-13250 | 1/1987 | Japan | 164/452 |
| 1-202351 | 8/1989 | Japan | 164/452 |
| 1-328063 | 8/1987 | U.S.S.R. | 164/452 |

*Primary Examiner*—Paula A. Bradley
*Assistant Examiner*—Rex E. Pelto
*Attorney, Agent, or Firm*—Hopgood, Calimafde, Kalil, Blaustein & Judlowe

[57] ABSTRACT

An improved method for controlling the clamping forces exerted on opposing sidewalls of a casting mold during a continuous casting operation, which comprises the steps of presetting the mold for the maximum load to be experienced by the sidewalls of the mold, securing the mold at the presetting, and, through displacement measuring devices and hydraulic spring mechanisms, controlling the forces exerted upon the sidewalls during the continuous casting operation as a function of the thermodynamic stresses to which the mold is subjected.

23 Claims, 5 Drawing Sheets

METHOD FOR CONTROLLING THE CLAMPING FORCES EXERTED ON A CONTINOUS CASTING MOLD

This application is a continuation of application Ser. No. 565,041, filed Aug. 9, 1990, now abandoned.

DISCLOSURE OF THE INVENTION

The invention relates to continuous casting molds and, more specifically, to an improved method for controlling the clamping forces exerted on a casting mold during a continuous casting operation.

Conventional casting molds comprise two pairs of opposed sidewalls. The first pair have wide faces, one being fixed and the other being movable. The second pair of sidewalls have narrow faces, each being movable so as to vary the mold size. In operation, the wide faced pair are clamped against the narrow faced pair such that a sealed sleeve is formed therebetween.

However, holding the mold in a clamped position during the casting operation while controlling the heat induced forces exerted on the mold has long been a difficult task. Upon the introduction of molten metal into the mold, the mold expands. Thereafter, the continuous casting operation experiences continuous expansion (heating) and contraction (cooling) of the mold. Accordingly, to prevent damage to copper face plates lining the mold sidewalls, breakout (tearing of the solidified skin) of the slab (casted metal) produced, and damage to the mold and associated machinery, it is desirable to maintain the sidewalls clamped securely together as a function of the forces to which the mold is subjected.

Some casting systems provide for manual adjustment of the clamping mechanism periodically by a worker to maintain a constant clamping force on the mold. Other systems utilize electronic sensing equipment to measure and adjust the clamping force exerted on the mold sidewalls so as to maintain the mold at a predetermined value for a particular mold size. This predetermined value (force) is then maintained essentially constant during the casting operation by a spring mechanism and mechanical jack which bias the wide faced walls against the narrow faced walls. A load cell on the mold reads the force exerted and provides an output signal proportional thereto. The load cell also senses variations in the fluidostatic pressure exerted by the mold contents resulting from changes in production requirements. Thereby, the degree of clamping force exerted by the wide faced walls on the narrow faced walls is measured and can be adjusted as a function of mold width by control of the mechanical jack. This is done in an attempt to prevent undue strain on the frame and support structure of the mold, opening of the mold, and damage to the molded product.

During the casting operation, the interior size of the mold and, hence, the width of the metal slab produced is varied by changing the distance between the narrow sidewalls. However, in addition to accounting for thermal induced expansion of the mold, the clamping forces on the mold must also be varied as a function of mold width, i.e., the fluidostatic pressure exerted by the mold contents on the sidewalls.

Consequently, heavy duty clamping mechanisms, such as mechanical jacks, are required having the capability of clamping over a broad range of forces. Aside from the expense of such heavy duty clamping arrangements, less precision is provided in response to expansion of the casting mold. In addition, because a more complex system of forces must be offset to maintain the mold in a clamped position, continuous adjustment of the mold sidewalls is necessary.

Thus, it is an object of the present invention to provide a precise, reliable, simple and economical method for controlling the clamping forces exerted on a casting mold during a continuous casting operation regardless of the mold size, wherein the forces exerted upon the mold during the casting operation are a function of the thermodynamic stresses to which the mold is subjected, such as the speed of the casting operation, the temperature of the mold contents, the fluxing powder used, and the nature of the material being cast.

The above and other objects of the present invention are realized in a specific, illustrative method for controlling the clamping forces exerted on opposing sidewalls of a casting mold during a continuous casting operation, which comprises the steps of presetting the mold so as to accommodate the maximum load to be experienced by the sidewalls of the mold, securing the mold at the presetting, and controlling the forces exerted upon the sidewalls during the continuous casting operation as a function of the thermodynamic stresses to which the mold is subjected.

The above and other features and advantages of the present invention are realized in a specific, illustrative embodiment thereof, presented hereinbelow in conjunction with the accompanying drawing, in which.

The present invention sets forth a method for controlling the clamping forces exerted on opposing sidewalls of a casting mold during a continuous casting operation. The method comprises the steps of presetting the mold so as to accommodate the maximum load to be experienced by the sidewalls of the mold, securing the mold at the presetting, and controlling the forces exerted upon the sidewalls during the continuous casting operation as a function of the thermodynamic stresses to which the mold is subjected.

Figure 1:
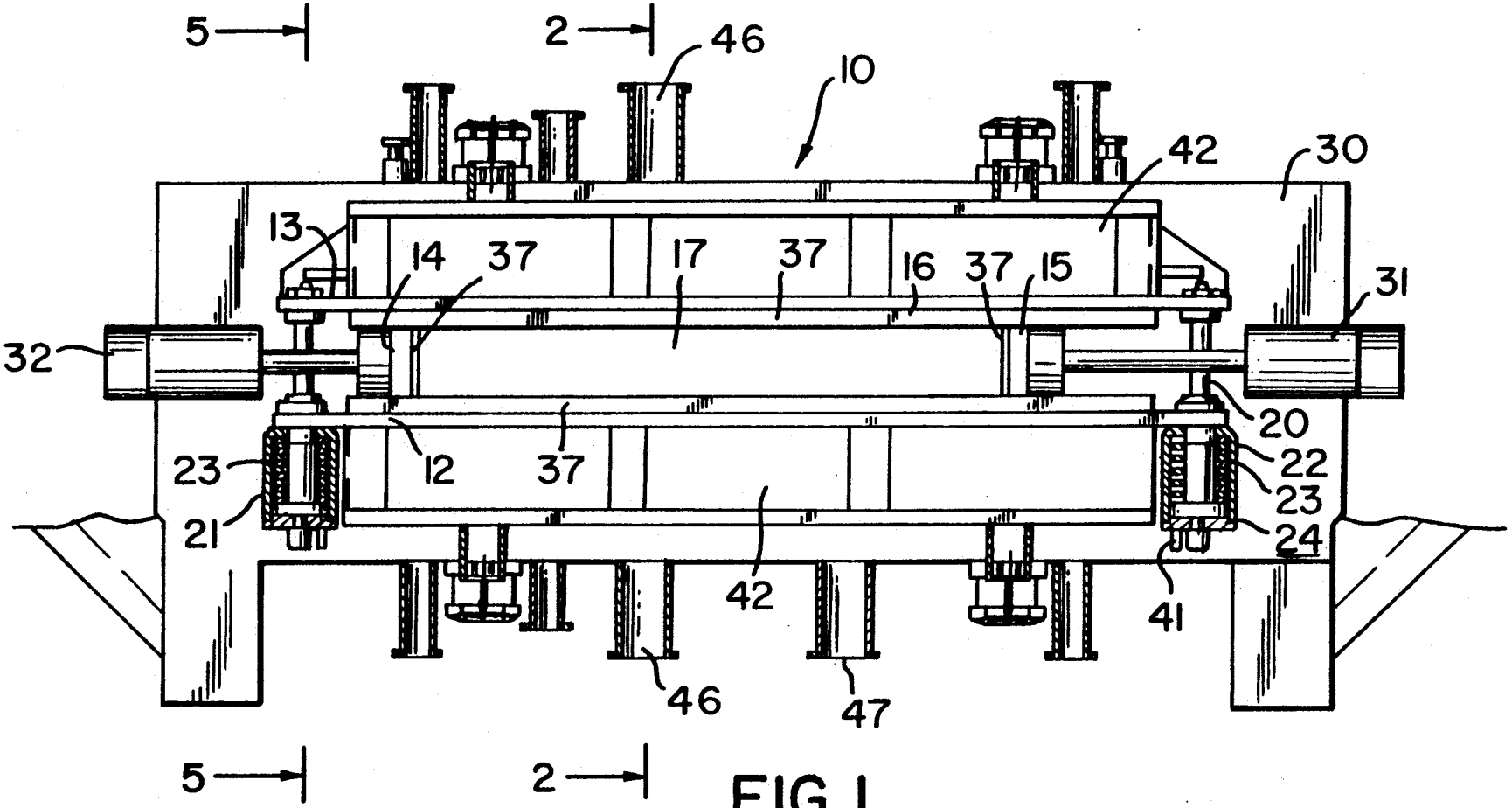
FIG. 1 is a plan view of a continuous casting mold in accordance with the present invention.

Referring now to the drawings and, more particularly to FIG. 1, there is shown a continuous casting mold assembly 10 in accordance with one aspect of the present invention. Mold assembly 10 has a pair of parallel disposed wide sidewalls 12, 13 and a pair of parallel narrow sidewalls 14, 15. The narrow sidewalls are disposed between and perpendicular to the wide sidewalls so as to form a three-dimensional rectangular sleeve 16 open at both ends 17, 18 (shown in FIG. 2). The wide sidewalls comprise fixed or stationary sidewall 13 and movable sidewall 12 for clamping and releasing the narrow sidewalls. In operation, the mold is oriented vertically such that one of the sleeve ends faces upward.

A clamping mechanism 20 is utilized for clamping the narrow sidewalls and the wide sidewalls together. The clamping mechanism comprises two pairs of cylinder housings 21, 22, each containing a Bellville spring 23 and an associated hydraulic system 24 for displacing the spring. The housings are mounted adjacent to each end of the movable wide sidewall so as to operatively bias the wide sidewalls against the narrow sidewalls. The narrow sidewalls, in turn, are supported against the stationary wide sidewalls. In this manner, the narrow sidewalls and the wide sidewalls are clamped together.

Figure 5:
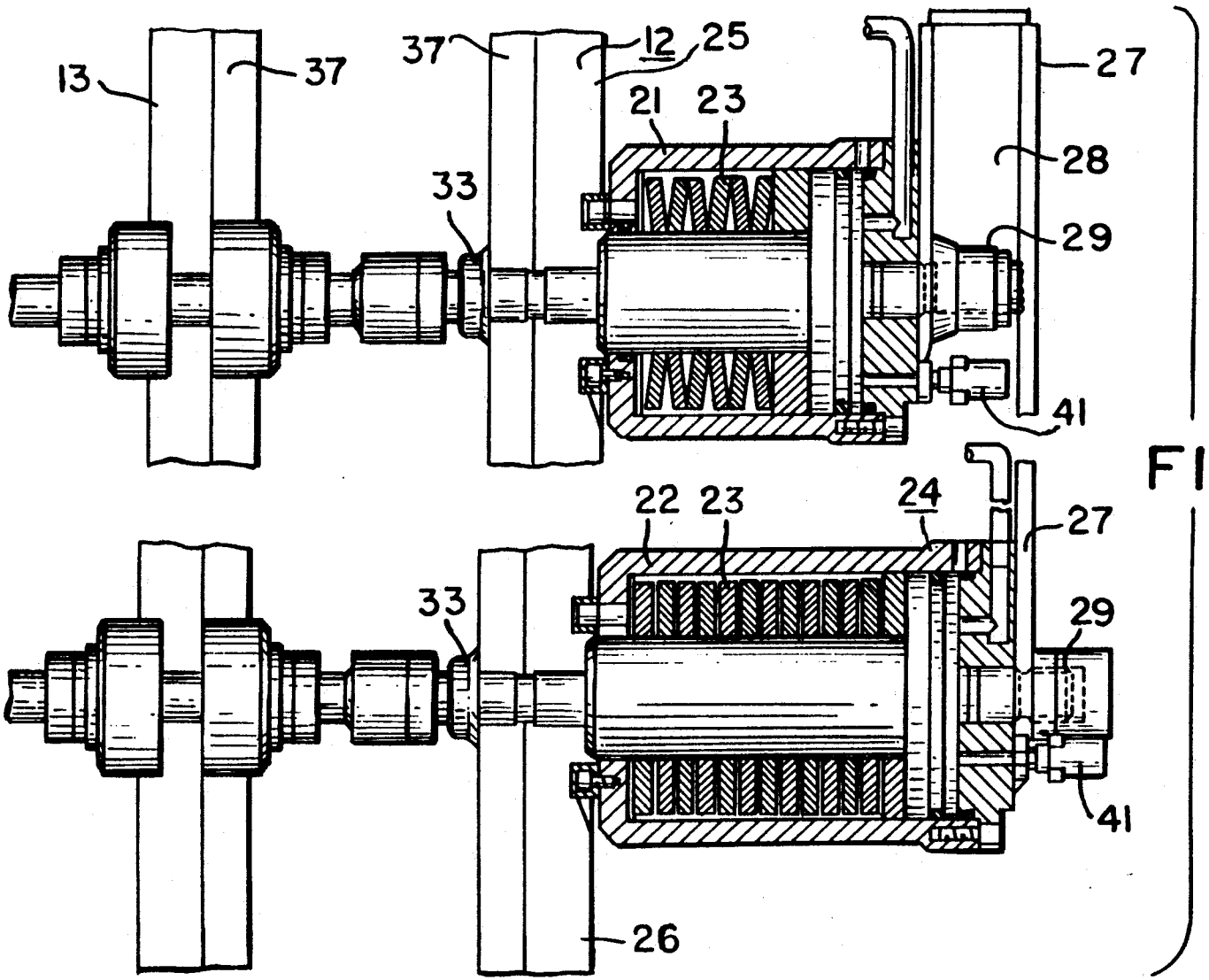
FIG. 5 is a section taken along 5—5 of FIG. 1.

The first pair of cylinder housings 21 are positioned on the left side of the movable wide sidewall at its upper and lower ends 25 and 26, respectively, as shown generally in FIGS. 1 and 5. The second pair of cylinder housings 22 are positioned adjacent to the right side of the movable wide sidewall, also at its upper and lower ends. In this configuration, the springs uniformly maintain the mold in a clamped position.

The mold is sized by varying the length of the mold interior, i.e., moving the spaced apart narrow sidewalls to a selected distance from one another. This is accomplished by activating drive mechanisms 31, 32 which effect movement of the narrow sidewalls the selected distance along the length of the wide sidewalls. The mold size is varied to accommodate the desired slab production requirements.

Figure 4:
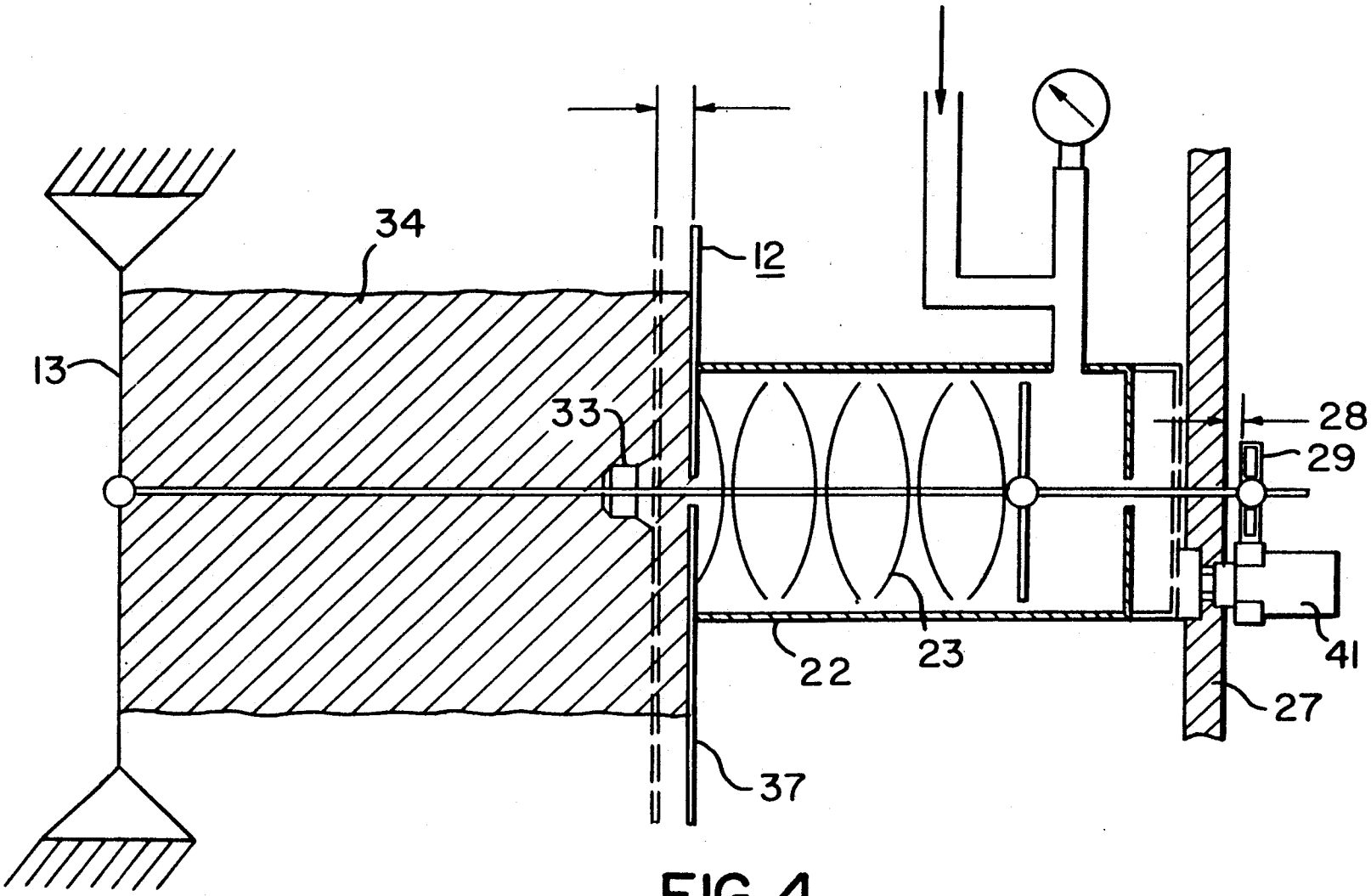
FIG. 4 is a representative diagram of the clamping mechanism and dimensional variation of the mold of FIG. 1.

Size variation may be done both prior to and during the casting operation. This is accomplished by first relieving the clamping forces exerted by the clamping mechanisms on the mold sidewalls. Specifically, hydraulic fluid in the cylinder housings hydraulically compresses the Bellville springs and moves the cylinder housing toward a shim 27, as shown in FIGS. 4 and 5. A gap 28 between shim 27 and a stop nut 29 dictates the range of permissible movement of the springs. This gap is adjusted and set by the stop nut prior to installation. As the sidewalls expand, the gap narrows, the hydraulic force being applied against the Bellville springs. The narrowed gap reflects the corresponding reduction in the clamping forces exerted on the sidewalls. Next, the drive mechanisms are activated so as to move the narrow sidewalls to a selected distance from one another. Finally, the hydraulic pressure exerted against each Bellville spring is increased so as to reimpose the clamping forces on the narrow sidewalls and reform the rectangular sleeve.

Prior to installation, the mold is preloaded to a selected design clamping force for clamping the narrow and wide sidewalls together. Specifically, the mold is preset to a condition which corresponds to the maximum relative condition of sidewall expansion that the casting operation will experience with the particular mold used and the selected operating conditions. As best seen in FIG. 5, the lower cylinders are suitably adapted and set to withstand a greater clamping force than the upper cylinders so as to compensate for the relative difference in fluidostatic loading between the upper end (lower fluidostatic depth) and the lower end (higher fluidostatic depth) of the mold. Once the cylinders have been preloaded at this design force, the sidewalls are secured in place by lock nut 33 to prevent opening of the mold, as shown in FIGS. 4 and 5. This configuration facilitates the control of sidewall expansion primarily as a function of thermodynamic stresses.

Sidewall expansion generally results from both fluidostatic loading of the mold (the volume of mold contents) and the thermodynamic stresses exerted on the mold. However, because the mold is preset for the maximum possible fluidostatic load, the volume of mold contents (the mold size) is not a factor to be accounted for in clamping the mold. As a result, the clamping forces required are greatly reduced, simplifying and economizing operation and slab production. Thereby, damage to the molded product, the mold, and its associated machinery is prevented.

Figure 2:
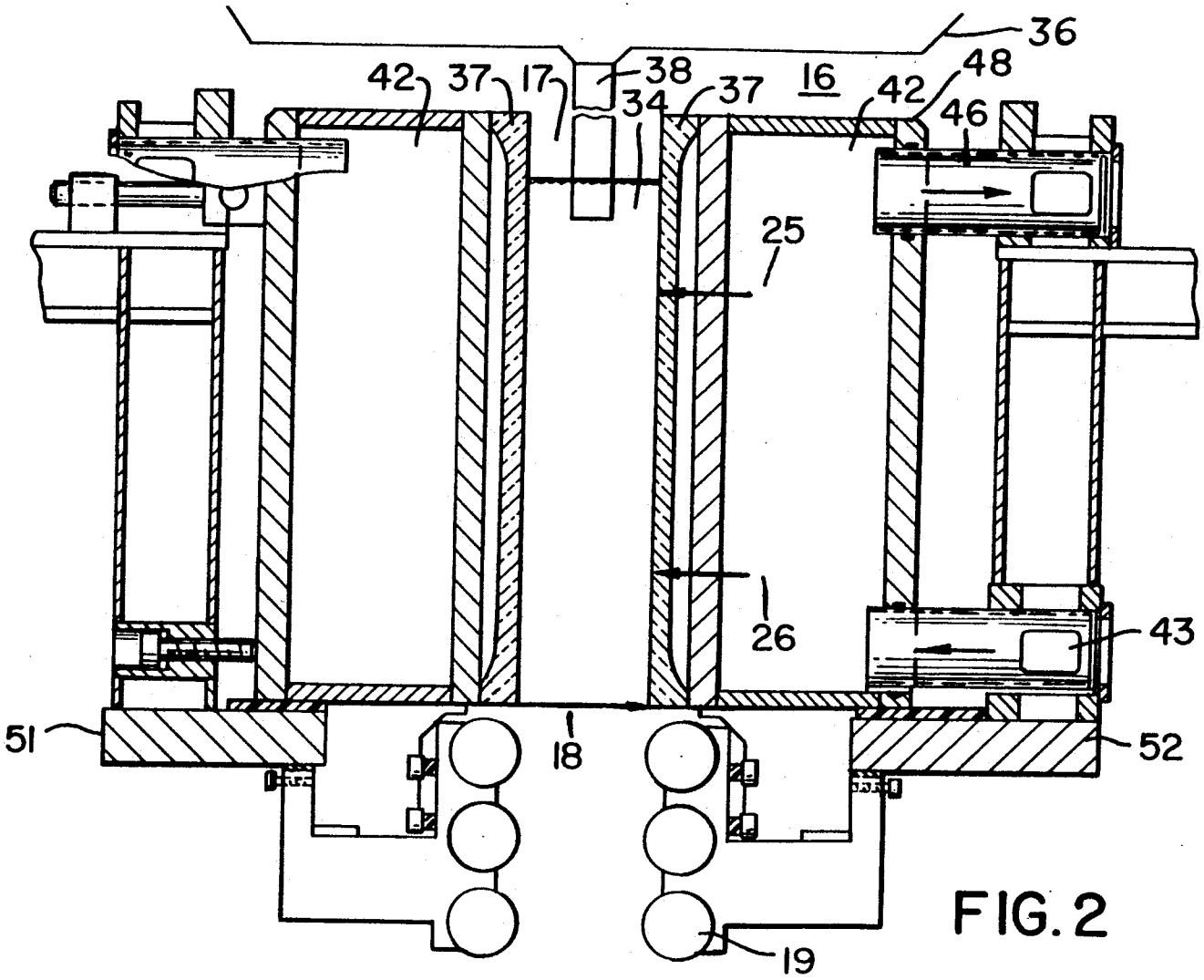
FIG. 2 is a section taken along 2—2 of FIG. 1.

At the start of the continuous casting process, a castable fluid 34 such as molten metal or the like, as shown in FIG. 2, is continuously introduced into the upper end 17 of the rectangular sleeve at a rate or line speed of, for example, 60 in./min. This is accomplished using a tundish 36 and a shroud 38. The shroud is mounted to the bottom of the tundish and extends downwardly therefrom. The tundish is suspended over the castable fluid such that the shroud is immersed in the molten metal. Molten metal is then continuously fed from the tundish through the shroud and into the mold.

Each sidewall of the mold is lined by a material effective in heat removal, such as copper plates 37. The copper plates extend from end to end of the respective interior sidewall faces to provide efficient heat removal (cooling of the mold) and to effect formation of the slab of material being cast, e.g., steel. As molten metal 34 flows into rectangular sleeve 16, the copper plates expand. Thereby, stresses are exerted upon both the mold sidewalls and the clamping mechanism, as best seen in FIG. 4. Simultaneously, a solidified skin or shell begins to form along the sidewall boundary of the molten metal, the thickness of the skin increasing in proportion to the distance travelled by the metal down through the sleeve.

After a solidified shell has been formed along the perimeter of the material being cast, the slab produced exits the mold through the bottom of rectangular sleeve 16, the mold being transported by foot rollers 19, as shown in FIG. 2.

As shown generally in FIGS. 1, 4 and 5, a displacement measuring device 41, for example, an LVDT (linear variable-differential transformer), is provided on the clamping mechanism to detect and measure the relative change in displacement of the mold sidewalls as compared to the preset secured position. Upon sidewall expansion, the LVDT senses the corresponding increased hydraulic pressure against the Bellville springs. Thereby, the springs contract and the clamping forces are relieved an increment necessary to maintain the sidewalls in a clamped position without damage to the copper plates or breakout of the mold.

As the level of the mold contents is lowered, copper plates 37 contract in size. Upon contraction, the LVDT senses the corresponding decrease in hydraulic pressure on the Bellville springs, thereby the increasing clamping forces so as to prevent opening of the mold. By controlling the clamping forces exerted on the mold during the casting operation, formation of fins on the casted product is prevented. Such control also prevents the exertion of undue stress on the sidewalls of the mold at the start of the casting process due to the initial heat transferred from the mold contents.

Non-steady state casting conditions characteristic of continuous casting operations, i.e., during changes in the speed of operation and replacement of the tundish and shroud assembly, cause variation in the temperature of the mold. The temperature change, in turn, causes a change in the thermodynamic stresses exerted upon the sidewalls and results in either their expansion or contraction. Therefore, the clamping forces required by the upper and lower cylinders are changed to maintain the mold clamped together.

Figure 3:
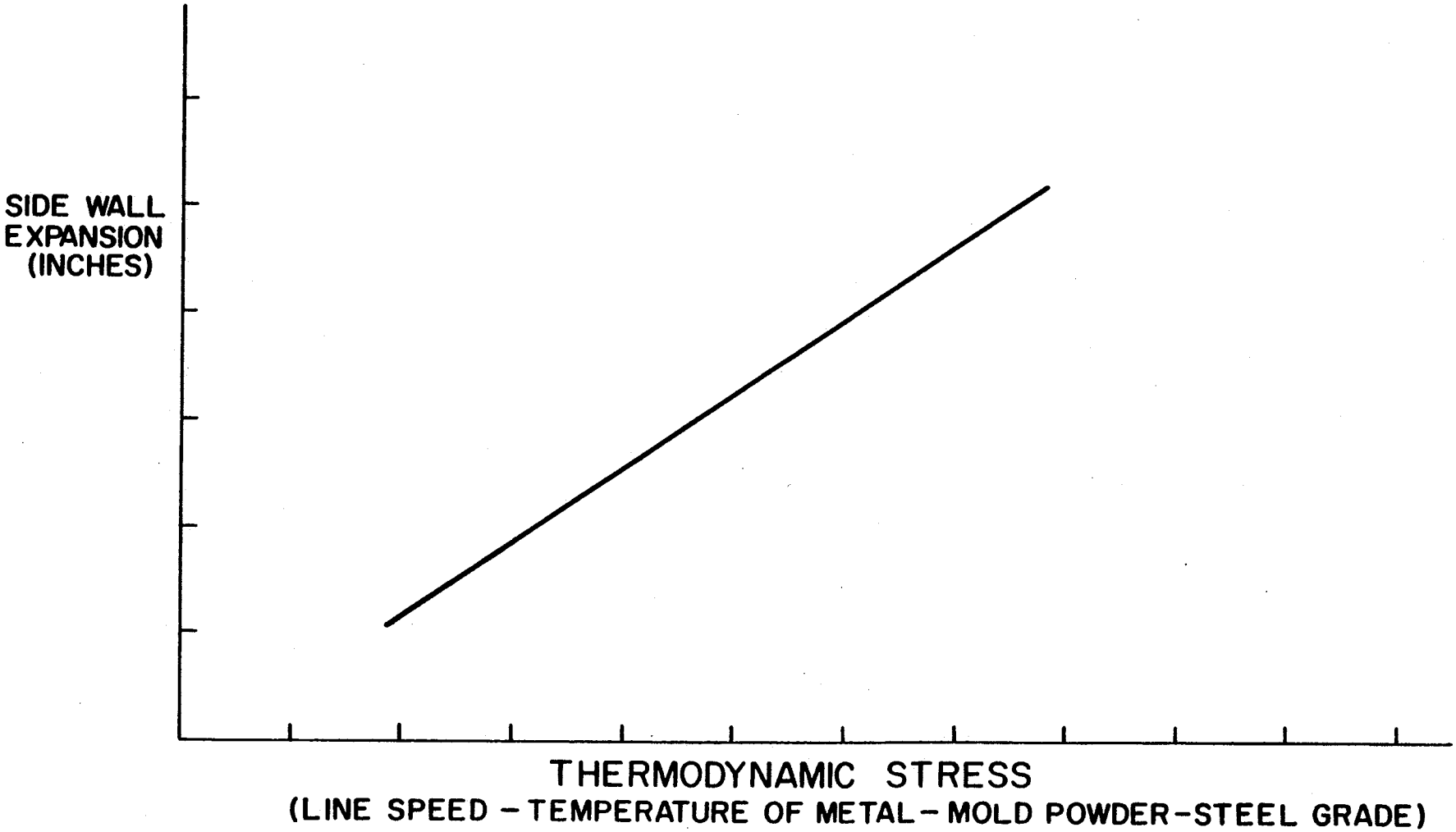
FIG. 3 is a graph schematically illustrating the relationship of the sidewall expansion of the mold to the thermodynamic stresses experienced during the casting operation.

As shown in FIG. 3, expansion of the mold sidewalls is a function of the thermodynamic stresses on the mold.

During the continuous casting process, as the thermodynamic stresses of the casting system increase, the copper plates expand to an even greater degree. Conversely, as the thermodynamic stresses decrease, the plates contract. The spring and LVDT configuration then controls the clamping force on the mold by providing continuous hydraulic adjustment of the Bellville springs, so as to maintain the mold in a clamped and closed position.

It has been found that thermoexpansion of the mold sidewalls is at a maximum in the region along the upper end of the casting mold (at the meniscus of the molten metal). This is because the temperature at the meniscus level is at a maximum for the mold. The temperature gradient then gradually tapers off with increasing mold depth, thus defining a negatively sloped curve which represents the temperature (cooling) gradient of the mold. Accordingly, the cylinder housings at the mold upper end are adapted to compensate for the differing magnitudes of expansion experienced at the particular meniscus levels or depths of molten metal. The housings at the lower end of the mold, in turn, experience less thermoexpansion due to the cooling gradient of the mold.

The thermodynamic stresses include the speed of the casting operation (line speed), the temperature of the mold contents, the fluxing powder used, and the nature of the material being cast. In particular, as the line speed increases, the temperature of the casting system increases causing the temperature gradient for the mold to shift upward and the slope of the gradient to flatten. Consequently, it is necessary to adjust the clamping forces exerted by the upper and lower cylinders. Similarly, if a grade of steel is used which has a relatively higher (or lower) melting point (liquidous), the necessary operating temperature and the nature of the material being cast vary the thermodynamic stresses exerted upon the mold. Last, the fluxing powder used to prevent bonding between the copper plates and the material being cast causes variation in the operating temperature and, hence, the temperature gradient of the mold.

Referring again to FIGS. 1 and 2, each wide faced sidewall has a chamber or water box 42 on the face opposite to that mounting the copper plate for storing a cooling fluid such as water or the like. Each water box is located adjacent to one of the wide sidewalls and is supported by a corresponding shelf 51 or 52. During the continuous casting process, water is introduced into each water box through inlet pipes 43, 44. Inlet pipes 43, 44 are connected to the lower end 45 of the water box and outlet pipes 46, 47 are connected to the upper end 48 of the box for transporting water to and from the box, respectively.

As the water passes through the chamber, it effects cooling of the mold. Upon entering the chamber, the water continuously absorbs heat from the molten metal. The heat then exits the system through the water flowing from the water box. The introduction of water into the box, in turn, cools the mold and aids in solidifying the casted product. In effect, the pipe and water box system serves as a continuous heat exchanger.

Alternatively, or concurrently with the present embodiment, shelves 51, 52 (shown in FIG. 2) cantilever the foot rollers and support corresponding sidewalls of the mold, the maximum fluidostatic pressure moment acting proximate to the shelves.

The above-described arrangement and methodology is merely illustrative of the principles of the present invention. Numerous modifications and adaptions thereof will be readily apparent t those skilled in the art without departing from the spirit and scope of the present invention. For example, although the present invention has been described as being adapted for casting metal products and the like, it is understood that any material could be cast giving consideration to the purpose for which this invention is intended. In addition, while a rectangular, variable width mold has been described for operation in a vertical orientation, it is also understood that any suitably oriented or configured mold could be utilized consistent with the principles set forth herein.

What is claimed is:

1. A method for controlling the clamping forces exerted on opposing sidewalls of a casting mold during a continuous casting operation, which comprises the steps of presetting the mold so as to accommodate the maximum load to be experienced by the sidewalls of the mold, securing the mold at the presetting, and controlling the forces exerted upon the sidewalls during the continuous casting operation as a function of thermodynamic stresses to which the mold is subjected

2. The method set forth in claim 1 wherein the thermodynamic stresses include the line speed of the continuous casting operation.

3. The method set forth in claim 1 wherein the thermodynamic stresses include the temperature of the mold contents.

4. The method set forth in claim 1 wherein the thermodynamic stresses include the fluxing powder used during the continuous casting operation.

5. The method set forth in claim 1 wherein the thermodynamic stresses include the nature of the material being cast.

6. The method set forth in claim 1 wherein the maximum load includes the maximum pressure load to be exerted by the mold contents.

7. The method set forth in claim 1 wherein the maximum load includes the forces exerted due to expansion of the sidewalls.

8. The method set forth in claim 1 wherein controlling the forces exerted upon the sidewalls includes the step of determining the clamping force on the sidewalls.

9. The method set forth in claim 1 wherein controlling the forces exerted upon the sidewalls includes the step of varying the clamping forces on the sidewalls so as to compensate for changes in the thermodynamic stresses.

10. The method set forth in claim 1 wherein securing the mold at the presetting includes the step of locking the sidewalls at the presetting.

11. A method for controlling the clamping forces exerted on opposing sidewalls of a casting mold during a continuous casting operation, which comprises the steps of presetting the mold so as to accommodate the maximum load to be experienced by the sidewalls of the mold, locking the mold at the presetting, determining the clamping force exerted on the sidewalls during the continuous casting operation as a function of thermodynamic stresses exerted upon the mold, and varying the clamping forces exerted on the sidewalls so as to compensate for changes in the thermodynamic stresses.

12. A method for controlling the clamping forces exerted on opposing sidewalls of a casting mold during a continuous casting operation, which comprises the steps of presetting the mold so as to accommodate the maximum load to be experienced by the sidewalls of the mold, securing the mold at the presetting, and controlling the forces exerted upon the sidewalls during the continuous casting operation as a function of thermodynamic stresses to which the mold is subjected so as to maintain a selected operation speed relatively constant.

13. The method set forth in claim 12 wherein the thermodynamic stresses include the temperature of the mold contents.

14. The method set forth in claim 12 wherein the thermodynamic stresses include the fluxing powder used during the continuous casting operation.

15. The method set forth in claim 12 wherein the thermodynamic stresses include the nature of the material being cast.

16. The method set forth in claim 12 wherein the maximum load includes the maximum pressure load to be exerted by the mold contents.

17. The method set forth in claim 12 wherein the maximum load includes the forces exerted due to expansion of the sidewalls.

18. The method set forth in claim 12 wherein controlling the forces exerted upon the sidewalls includes the step of determining the clamping force on the sidewalls.

19. The method set forth in claim 12 wherein controlling the forces exerted upon the sidewalls includes the step of varying the clamping forces on the sidewalls so as to compensate for changes in the thermodynamic stresses.

20. The method set forth in claim 12 wherein securing the mold at the presetting includes the step of locking the sidewalls at the presetting.

21. A method for controlling the clamping forces exerted on opposing sidewalls of a casting mold during a continuous casting operation, which comprises the steps of presetting the mold so as to accommodate the maximum load to be experienced by the sidewalls of the mold, locking the mold at the presetting, determining the clamping force exerted on the sidewalls during the continuous casting operation as a function of thermodynamic stresses exerted upon the mold, and varying the clamping forces exerted on the sidewalls so as to compensate for changes in the thermodynamic stresses and maintain a selected operation speed relatively constant.

22. A method for controlling the clamping forces exerted on opposing sidewalls of a casting mold during a continuous casting operation, which comprises the steps of presetting the mold width so as to accommodate the maximum fluidostatic load to be experienced by the sidewalls of the mold during the casting operation, securing the mold at the presetting, and varying the forces exerted upon the sidewalls during the continuous casting operation primarily as a function of thermodynamic stresses to which the mold is subjected.

23. A method for controlling the clamping forces exerted on opposing sidewalls of a casting mold during a continuous casting operation, which comprises the steps of presetting the mold width so as to accommodate the maximum fluidostatic load to be experienced by the sidewalls of the mold during the casting operation, locking the mold at the presetting, determining the clamping force exerted on the sidewalls during the continuous casting operation primarily as a function of thermodynamic stresses exerted upon the mold, and varying the clamping forces exerted on the sidewalls so as to compensate for changes in the thermodynamic stresses.

* * * * *